United States Patent [19]

Jefferson

[11] Patent Number: 4,704,811

[45] Date of Patent: Nov. 10, 1987

[54] TRENCHING ATTACHMENT FOR A BACKHOE

[75] Inventor: Stuart T. Jefferson, Lorton, Va.

[73] Assignee: Jefferson Development, Inc., Lorton, Va.

[21] Appl. No.: 924,430

[22] Filed: Oct. 29, 1986

[51] Int. Cl.[4] ..... E02F 5/12

[52] U.S. Cl. ..... 37/80 A; 37/117.5; 37/141 R; 37/142.5; 37/DIG. 12

[58] Field of Search ..... 37/DIG. 3, DIG. 12, 37/DIG. 16, 142.5, 141 R, 118 R, 117.5, 80 A; 414/724, 912

[56] References Cited

U.S. PATENT DOCUMENTS

| | | | |
|---|---|---|---|
| 3,958,347 | 5/1976 | Heitman | 37/118 R X |
| 4,009,529 | 3/1977 | Johnson | 37/141 R X |
| 4,043,061 | 8/1977 | Heitman | 37/141 R |
| 4,365,428 | 12/1982 | Shumaker | 37/141 R X |

FOREIGN PATENT DOCUMENTS

| | | | |
|---|---|---|---|
| 607667 | 11/1960 | Canada | 37/117.5 |
| 443382 | 2/1968 | Switzerland | 37/141 R |

*Primary Examiner*—Edgar S. Burr
*Assistant Examiner*—Joseph McCarthy
*Attorney, Agent, or Firm*—Richard C. Litman

[57] ABSTRACT

A trenching attachment for removable attachment to the bucket of a backhoe is disclosed which converts the backhoe from a stationary digging machine into a continuous trenching machine creating a V-shaped trench suitable for installation of pipes or conduits or the creation of fire breaks. With the attachment installed on the backhoe bucket the operator may control the depth of cut with the backhoe controls as the backhoe is moved forward, creating graded trenches for the installation of drainage or sewer lines.

1 Claim, 4 Drawing Figures

TRENCHING ATTACHMENT FOR A BACKHOE

BACKGROUND OF THE INVENTION

This invention relates to machinery for digging ditches or trenches in the earth and in particular to a device which converts a normally stationary machine into a continuous trenching machine. The device comprises an attachment for the bucket of a backhoe which converts the backhoe into a moving trencher, providing a V shaped ditch for installation of piping or conduit or for the creation of fire breaks.

The backhoe is a primarily a ditch digging machine which is conventionally operated by placing the backhoe in one position and digging the ditch to the required depth to the extent that the arm of the backhoe will reach and then moving the machine forward and repeating the process. Various shapes of ditches may be excavated by changing the bucket or the backhoe. With the installation of the present invention the conventional rectangular bucket of a backhoe is converted to a V shaped trenching tool, permitting the backhoe to dig a trench or create a fire break while moving continuously forward and to vary the depth of the trench as it moves along. The same attachment provides the means for filling in the trench after the installation of pipes or conduits in the trench, returning the earth's surface to its original grade.

SUMMARY OF THE INVENTION

A V shaped trenching tool for attachment to the conventional backhoe bucket is disclosed which converts the backhoe into a continuous trenching machine. The tool is readily installed and removed from the bucket of the backhoe and permits the backhoe to be used to dig trenches for the installation of pipes or conduits or to create fire breaks. The conventional hydraulic system of the backhoe may be used to move the tool vertically to create graded trenches such as those required when installing drainage piping or the like.

In operation the trenching tool is installed on the bucket of a backhoe and the backhoe bucket adjusted so that the blade of the tool is in a vertical position. The blade of the tool is then inserted into the ground and the depth of cut desired adjusted using the backhoe bucket's hydraulic system. The backhoe is then run forward, creating a V shaped ditch of the desired width and depth. While in movement the depth of the trench may be adjusted, using the backhoe controls, to create graded trenches. Markings are provided on the blade to enable the operator to gauge the depth of cut and these assist him in creating an evenly graded trench.

When the trench is to be refilled the backhoe is returned to its original starting position and the bucket of the backhoe turned until the trenching tool blades are parallel to and in contact with the ground. The backhoe is then run forward and the V shaped blades sweep the berm piled along the trench in the trenching operation back into the trench, providing an evenly graded surface.

DESCRIPTION OF THE PREFERRED EMBODIMENTS

Figure 1:
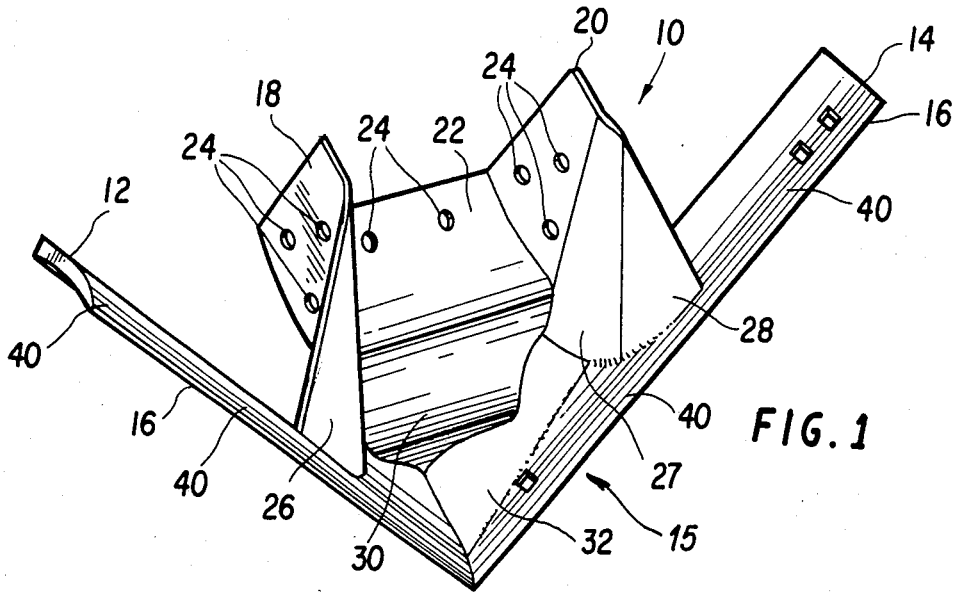
FIG. 1 is a perspective view of the trenching attachment.

Referring now to the drawings and in particular to FIG. 1 there is shown the trenching attachment for a backhoe 10. Trenching attachment 10 has twin trenching blades 12 and 14 connected as to form a V shaped ground cutting blade 15, each of the cutting blades being provided with a cutting edge 16. Attachment to the bucket of the backhoe is provided by a side mounting members 18 and 20 and base mounting member 22 which form a channel section which fits into the inside of the backhoe bucket. Holes 24 are provided in each of the mounting members for securing the trenching attachment to the backhoe bucket. A transition section comprised of transition members 30 and 32 connect the base mounting member 22 to the V shaped cutting blades and transition sections 26, 27 and 28 connect the side mounting members 18 and 20 to the cutting blade. Depth markings 40 are provided on the blades 12 and 14 to assist the operator of the backhoe in gauging the depth of the trench to be cut.

Figure 2:
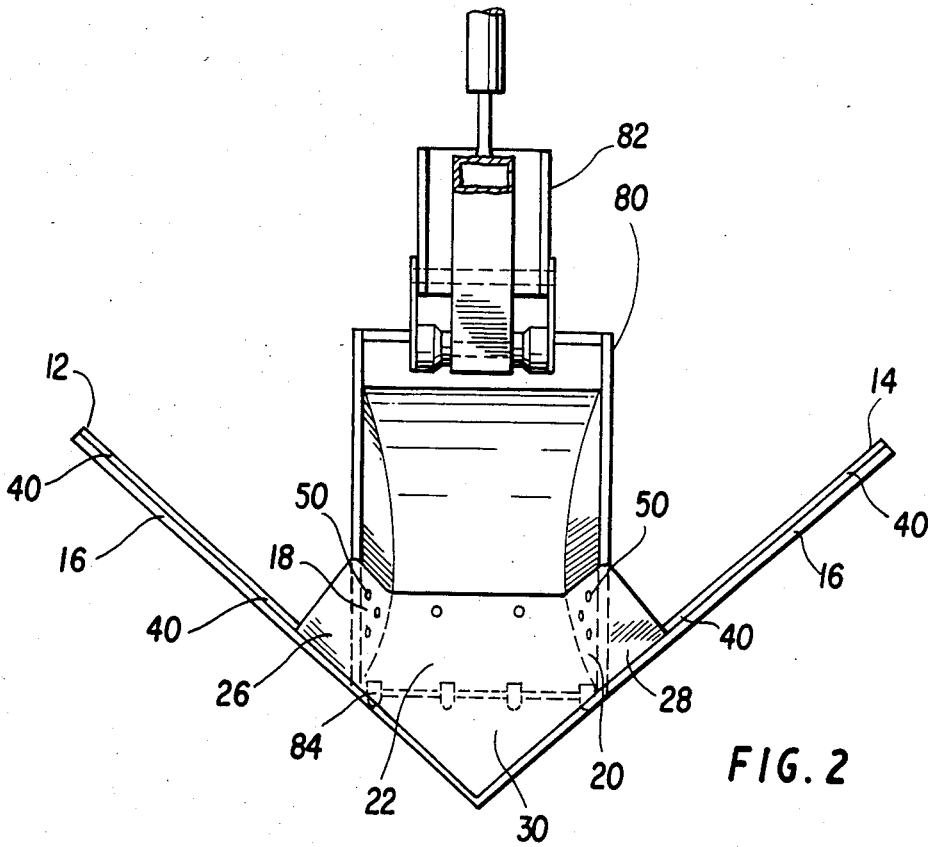
FIG. 2 is a front elevation view of tool installed on a backhoe bucket.

Referring now to FIG. 2 there is shown the trenching attachment attached to the bucket 80 of a backhoe. The position of bucket 80 is controlled by linkage 82 which will not be further described but which permits the backhoe bucket to be rotated and lifted into various positions. As may be seen, side members 18 and 20 and base member 22 are secured to the inside of the backhoe bucket by bolts 50 passing through the holes 24 in the mounting members and bucket. Bucket teeth 84 are covered by the trenching attachment and the backhoe bucket provides support for the trenching attachment and absorbs the stresses involved when the attachment is in use.

Figure 3:
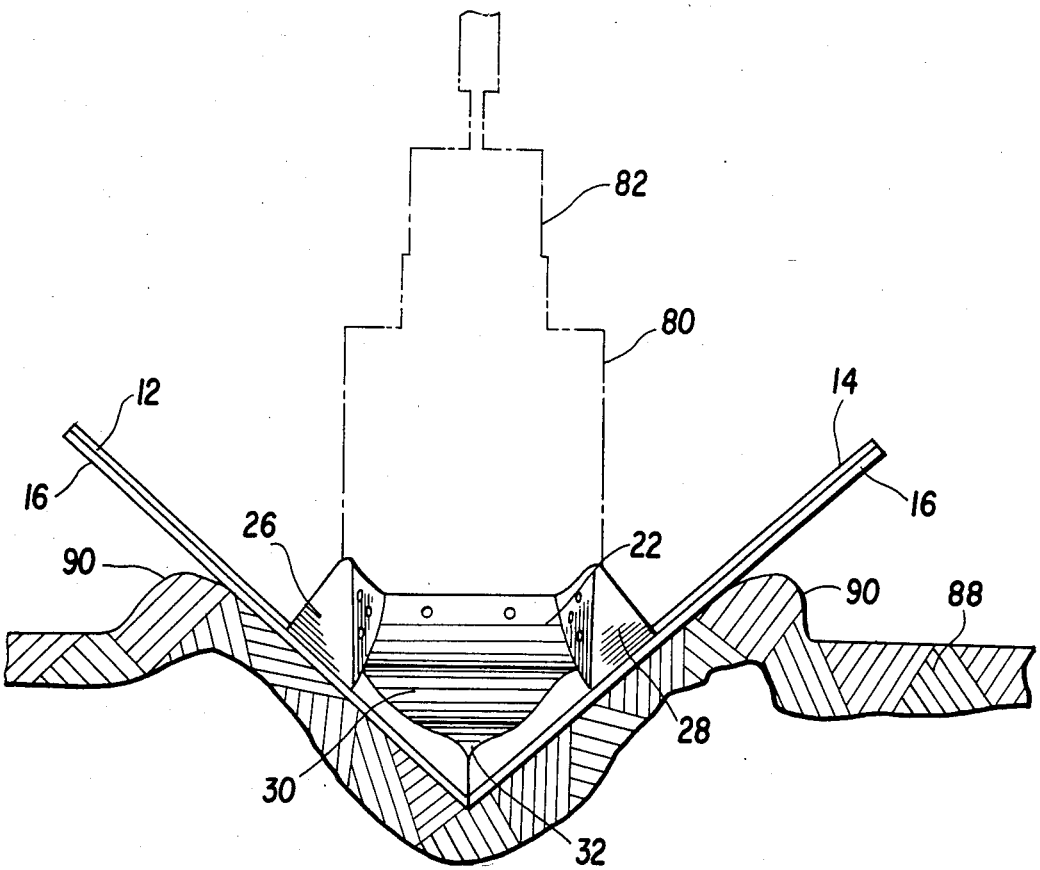
FIG. 3 is front elevation view of the trenching attachment shown in the digging position.

In FIG. 3 the attachment is shown in its trenching position attached to the backhoe bucket and as it would appear when creating a trench. The bucket 80 is positoned so that the blades 12 and 14 are vertically positioned and the blades are then lowered into the earth 88. When the backhoe is then driven forward, the trenching attachment cuts a V shaped trench, depositing a berm 90 along both sides of the trench. During the trenching operation the operator of the backhoe may raise or lower the bucket and trenching attachment with the backhoe controls to provide a trench having a variable grade such as those required for the installation of drainage pipes and sewer lines.

Figure 4:
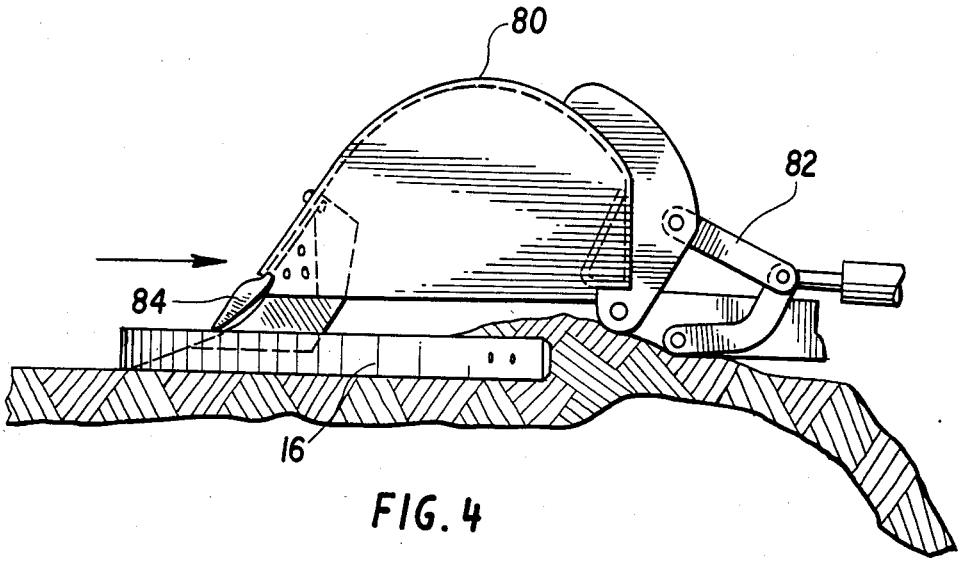
FIG. 4 is a side elevation view of the trenching attachment shown in the filling position.

When the trench is completed and the pipe or conduit laid in the trench the trenching attachment is employed to fill the trench as shown in FIG. 4. The backhoe is returned to the beginning of the trench and the backhoe bucket 80 is positioned so that the trenching blades are parallel with and in contact with the ground and the backhoe is then driven forward. The blades collect the berm 90 deposited by the trenching operation and return it to the trench, filling the trench and leveling the ground in one operation.

What is claimed is:

1. A trenching attachment for removeable attachment to the bucket of a backhoe, said bucket including inside walls and an inside bottom, said inside walls each having a front edge, a V shaped ground cutting blade having a cutting edge for cutting the earth, side mounting members for attachment to said inside walls of the backhoe bucket, a bottom mounting member for attachment to said inside bottom of the backhoe bucket, said side and bottom mounting members being connected to form a channel, transition members for connecting the cutting blade to the channel formed by the side and bottom mounting members so that the plane of the cutting edge of said cutting blade is substantially parallel with the plane of the front edge of said backhoe bucket inside walls, and said cutting blade, mounting members and transition members forming a single trenching attachment to a backhoe bucket which when the blades are vertically disposed and the backhoe is moved forward a V shaped trench will be cut through the ground, depositing a berm at each side of the trench and when the blades are horizontally disposed said blades will collect the berm deposited by the trench cutting operation and replace it in the trench.

* * * * *